United States Patent [19]
Busselet
[11] 4,245,967
[45] Jan. 20, 1981

[54] PUMP FOR A HAND ACTUATED DEVICE FOR PRODUCING AN ATOMIZED SPRAY

[75] Inventor: Jean-Claude G. Busselet, Le Neubourg, France

[73] Assignee: Establissements Valois, Neubourg, France

[21] Appl. No.: 935,778

[22] Filed: Aug. 22, 1978

[30] Foreign Application Priority Data

Sep. 16, 1977 [FR] France ..... 77 27967

[51] Int. Cl.[3] ..... F04B 7/00; F04B 7/04
[52] U.S. Cl. ..... 417/510
[58] Field of Search ..... 417/510, 511, 513, 520, 417/547; 222/321

[56] References Cited

U.S. PATENT DOCUMENTS

| | | | |
|---|---|---|---|
| 3,187,960 | 6/1965 | Gorman | 222/321 |
| 3,500,761 | 3/1970 | Clevenger et al. | 417/513 |
| 3,865,313 | 11/1975 | Rondo | 222/321 |
| 4,010,874 | 3/1977 | Steinman | 222/321 |
| 4,082,222 | 4/1978 | Boris | 222/321 |
| 4,147,476 | 4/1979 | Warren | 417/328 |

FOREIGN PATENT DOCUMENTS

| | | | |
|---|---|---|---|
| 2708155 | 11/1977 | Fed. Rep. of Germany | 417/520 |

*Primary Examiner*—William L. Freeh
*Attorney, Agent, or Firm*—Oblon, Fisher, Spivak, McClelland & Maier

[57] ABSTRACT

A pump for a hand actuated device for producing an atomized spray includes a cylinder mounted with a cover cap on the neck of a container and closed in the bottom by a valve member and a stem operating a piston by means of a spring means. The discharge of the product is made through an inner passage in the stem and a lateral opening which is cleared out by movement of the piston when compressing above the spring caused by the increase of fluid pressure. The discharge pressure is so uniform and controlled by the strength of the spring, and atomization is always correct. The formation of drops as well as leakage are also avoided. The device is useful for atomizing perfumes, medicines, cleaning products, etc.

1 Claim, 1 Drawing Figure

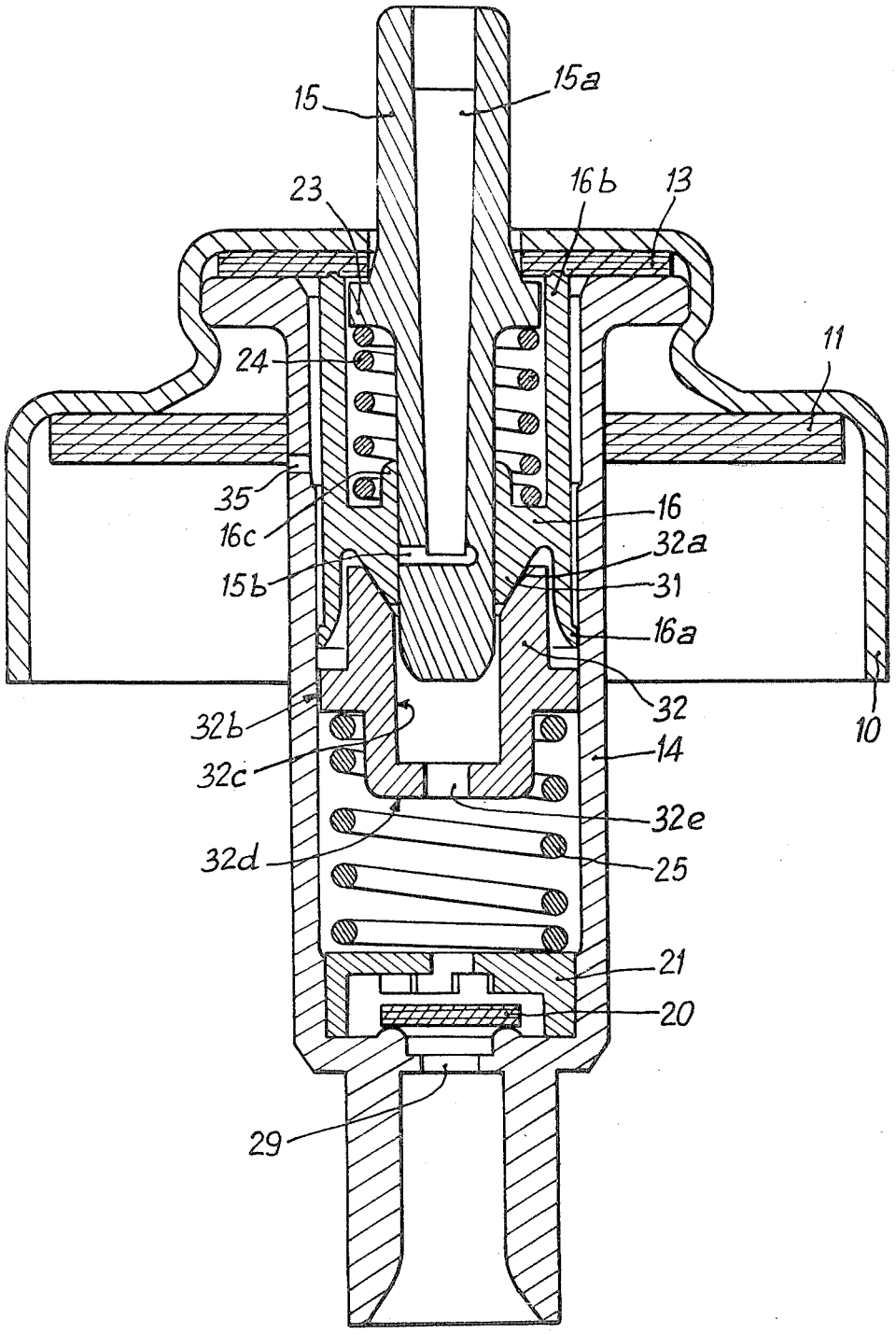
15
15a
23
16b
13
24
11
35
16
16c
32a
15b
31
16a
32
32b
10
14
32c
32e
32d
25
21
20
29

PUMP FOR A HAND ACTUATED DEVICE FOR PRODUCING AN ATOMIZED SPRAY

BACKGROUND OF THE INVENTION

1. Field of the Invention

The invention relates to a pump for a hand actuated device for producing an atomized spray.

2. Description of the Prior Art

French patent No. 76 05718 describes such a pump, designed in such a manner that minimum pressure is applied to a piston before initiating atomization. It is contemplated that such to avoid undesirable atomization when the pressure is not sufficient. In view of this result, the pump described in this patent comprises a cylinder having an end wall with a valve therein, a piston slidable in the cylinder, a hollow stem with a lateral opening at one end, being slidable in and extending through the piston and extending outside the cylinder at the opposite end thereof to the valve and having actuating means thereon, the piston having a gasket for covering and uncovering the lateral opening in the stem as the stem moves relative to the piston, and wherein the piston is biassed in opposite directions by two spring means, one of the spring means biassing the piston away from the cylinder end wall with the valve, and being weaker than the other spring means, said other spring means being positioned between the piston and a step on the hollow stem, and being in a relaxed state when the pump is not in use.

When the pressure is applied on the stem, there is provided a movement of the piston relative to the stem. This movement has two effects:

(1) it uncovers the lateral opening in the stem allowing the compressed fluid to escape towards an atomization nozzle, this opening being normally closed by the gasket of the piston when the pump is not in use;

(2) the stronger spring means between the piston and the step on the hollow stem is set in compression under a load corresponding to a minimum atomization pressure for the fluid.

The fluid can be moved to the nozzle and discharged outwardly only if the opening in the stem is uncovered by the piston, and accordingly, only if the spring is compressed. It is thus ensured that the fluid can be discharged only with a minimum pressure, corresponding to the compression of the spring means resulting from the shifting of the piston, necessary for uncovering of the discharge opening. This opening can remain open only if the pressure is maintained inside the valve. If pressure decreases, the spring means pushes the piston on the stem and the opening is closed, i.e. the atomization is stopped. Then, the fluid cannot be discharged with a pressure lower than a predetermined pressure.

If the fluid were expelled directly through finger pressure on the stem, it would be possible, if the pressure is not strong enough to cause undesirable atomization, to have formation of droplets, or even causing fluid to pour along the container.

Applicant has noted that, for a good operation of such a device, it is necessary that the discharge opening be perfectly closed as long as the pressure has not reached the prescribed value.

The quality of tightness is then of great importance. There is known a number of means, products, packings and other devices for securing every desirable quality of tightness. Nevertheless, in the present case, a valve is provided for closing a container which is discarded when empty and consequently, the container with its valve form only a wrapping and the price of the assembly should not be substantially higher than the price of a wrapping. But the quality of the valve must be sufficient to ensure correct operation during the whole service life of the container, i.e. until it is empty. As a consequence, it is not possible to use good conventional solutions for tightness in view of the cost which is too high for the contemplated use.

SUMMARY OF THE INVENTION

The present invention has for its object to provide means ensuring under economic conditions corresponding to the above mentioned use, proper sealing of the fluid discharge opening, until this opening is cleared, i.e. until the necessary pressure is established.

In the above mentioned patent, the piston is fitted with an annular gasket having a substantially rectangular section, and this gasket is slidably mounted on the stem for closing or clearing the discharge orifice. The quality of sealing is not sufficient, even with a costly mounting of the gasket, and too expensive for this application.

According to the present invention, the gasket is formed by a sealing member having a substantially triangular section (i.e. cone shaped) surrounding the stem, the edge of the sealing member being placed towards the inner end of the stem.

The gasket may be made of any suitable material and mounted on the piston, and may be fitted with a filler i.e. a circular ring applying the sealing member radially on the central stem. Nevertheless, such a construction is of a cost much too important for a device of the type hereinabove contemplated.

For this reason, according to another feature of the invention, the sealing member is made of the same material as the piston and is integral with this piston.

So as to avoid having the piston material biased in extension, according to another feature of the invention, there is further provided an annular compression means, i.e. a filler, in form of a crown, having a tapering surface matching the outer surface of the lip, and biassed in abutting relationship against the lip by means of a spring compressed between the piston and the cylinder bottom, so as to apply the sealing member against the stem. In this way, the sealing member material is biassed in compression, what is most favorable. Further, the filler may be used as a guiding member for the inner end of the actuating stem.

BRIEF DESCRIPTION OF THE DRAWING

Various objects, features and attendant advantages of the present invention will be more fully appreciated as the same becomes better understood from the following detailed description of the present invention when considered in connection with the accompanying drawing wherein the sole FIGURE is an axial sectional view showing a pump according to the invention.

DETAILED DESCRIPTION OF THE PREFERRED EMBODIMENT

The pump shown in the sole FIGURE comprises a cover cap 10, e.g. in aluminum, designed for being fixed on the neck of a convenient bottle or container (not shown) with a sealing gasket 11. A gasket 13 provides a seal between cap 10 and a pump cylinder 14. A piston 16 and a hollow stem 15 with an inner passage **15*a* are mounted in cylinder 14. The piston diameter is so designed as to allow smooth sliding thereof within cylinder 14, the lower edge being formed with a fluid sealing member 16***a*, to ensure fluid tightness with the inner wall of cylinder 14. When the pump is not in use, the upper edge 16*b* of piston 16 ensures tightness with gasket 13. The inner passage 15*a* opens upwardly at the center of stem 15. Downwardly, the passage is limited in depth and is connected with the exterior of the stem through a lateral orifice 15*b*. The upper portion of stem 15 projects out of the cap and allows operation of the pump. Cylinder 14 is closed in the lower portion thereof by a valve member 20, held in place by a convenient support 21. This valve member closes opening 29, which communicates with the inside of the container, and which can communicate with a dip tube, in a well-known conventional manner. The stem 15 is formed with a shoulder 23 and a first spring means 24 biassing said piston 16 by downwardly engaging with said shoulder. This spring means ensures the transmission of downward pressure from the stem to the piston. Shoulder 23 is also useful for guiding stem 15 inside the skirt 16*b* of piston 16, and for limiting upward movement of the stem, when coming into engagement with an inner edge portion of the central opening of gasket 13. A conventional actuating push-button (not shown), comprising a spray nozzle, is normally mounted on the stem. The push-button is fitted on the stem, and pressure applied by finger on the push-botton is transmitted to the piston through spring 24. A second spring means 25 biasses piston 16 upwardly, and also stem 15 by means of spring means 24. When the pump is not in use, the upper edge 16*b* of piston 16 should be applied against gasket 13. The seal between piston 16 and stem 15 is provided by a sealing portion 31 of the piston, having a substantially triangular section, forming a tightness or air tight lip. In view of improving tightness, if necessary in some uses such as with very fluid or high pressure products, it is possible to provide an upward tubular extension 16*c* of the piston.

When the pump is not in use, the lateral orifice 15*b* is in front of or above sealing member 31, and is thus perfectly closed. The seal between the outside and the inside of the container is thus provided on the one hand through contact of edge 16*b* with gasket 13 and, on the other hand, through contact of sealing member 31 and stem 15. In view of improving the seal as well as the operation conditions of sealing member 31, the pump comprises a pressing annular part, or filler 32, having an upwards disposed tapering (cone-shaped) surface 32*a* of suitable angle relating to the angle of sealing member 31, so that the pressure is maximum on the thin portion of sealing member 31. The load applied by spring means 25 on piston 16 is transmitted by filler 32. Filler 32 has an outer surface 32*b* in sliding engagement with the inner surface of cylinder 14, and an inner surface 32*c* provided for receiving, in sliding engagement, the end of stem 15. In this way, stem 15 is correctly guided in cylinder 14, in the upper portion through shoulder 23, and in the lower portion through fuller 32. The lower surface 32*d* of filler 32 provides an abutment surface of a stop means, in a plane perpendicular to the axis of the pump, cooperating with valve-holder 21, so as to limit the downward stroke of piston 16. An opening 32*e* is provided for the flowing of the fluid to be atomized, which should also pass between surface 32*c* and stem 15. In view of that, the sliding surface 32, as well as surface 32*b*, may be provided with grooves or any suitable means allowing the passage of fluid while ensuring guiding. When the pump is not in use, the pressure of spring means 25 should be higher than that of spring means 24, so that circular edge 16*b* of piston 16 suitably engages gasket 13. But, when stem 15 is depressed, the pressure of spring means 24 should increase more quickly than spring means 25 so that the difference of pressures between spring means 24 and 25 corresponds to the desired pressure of fluid in the lower part of cylinder 14.

An orifice 35 is provided in cylinder wall for allowing the replacement by air of the product expelled by the pump.

The pump above described operates in the following manner. When not in use, the seal in the valve is provided on the one hand by gasket 11 between cover cap 10 and container and, on the other hand, by gasket 13 between cover cap 10 and cylinder 14, and further, as cylinder 14 is open in 29 and 35, by contact between edge 16*b* and gasket 13, and by sealing member 31.

The container is filled with a liquid to be atomized. This has been accomplished before setting cover cap 10 on container neck. The cover cap may be lap-jointed, screwed or otherwise affixed on the container. The user has first to initiate the pump and operate it for expelling air until the lower part of cylinder 14 is filled with liquid. The user then depresses stem 15. As the liquid is substantially not compressible, piston 16 will move only a little, if at all, and spring means 24 will be compressed. The pressure of liquid increases especially as the stem end dives in the liquid mass. The resilience of various parts allows this balance of pressures, the seal being provided in the cylinder bottom thanks to the flexibility of tightness lip 16*a* and 31, and sealing member of valve member 20. When the liquid pressure balances the load of spring means 24, (including the counter load of spring means 25), piston 16 no longer means downward and the stem 15 moving alone uncovers opening 15*b* below the sealing member 31. The liquid is expelled quickly through opening 15*b* and passage 15*a* in the direction of spray nozzle (not shown) and the fluid pressure remains unchanged during this operation through spring means 24, which applies the desired load as long as opening 15*b* is cleared. When the user releases the pressure on stem 15, or when surface 32*e* engages the supporting means 21, piston 16, biased by spring means 24, closes opening 15*b*. The atomization is stopped and thus completely done under uniform pressure, which can be predetermined in suitably selecting characteristics of spring means 24 and 25. The automization will be accordingly of the best quality, i.e. no drops and no leakage from the spray nozzle.

Subsequently, the user ceases to apply pressure on stem 15. Spring means 24 expands immediately and opening 15*b* is then closed and finally spring means 25 resets the assembly upwardly. Liquid is drawn up through opening 29, valve member 20 being raised, and air replaces this liquid, passing through central opening of gasket 13 around the stem 15, and through orifice 35. When piston upper edge 16*b* engages gasket 13, air can no longer enter, and piston 16 is blocked. The pump has thus taken again its idle position and is ready for new operation.

Normally, the container should be held in a vertical position with the pump being in the position shown in the sole FIGURE. For this reason, the parts have been designated as the upper or the lower part when considering the FIGURE. But, quite evidently, the device can be operated in every position, provided that liquid to be atomized is present on valve member 20.

Filler 32 allows having a first rate seal with a tightness lip integral with piston 16. i.e. of a cheap material not requiring high characteristic precision, as for time or temperature. This selection of the filler size, particularly its length, provides a means for controlling the piston stroke, i.e. the amount to be sprayed for each pressure on the stem. It is also possible with only one pump size to provide for very different amounts of products to be expelled in a single stroke through a suitable selection of the filler length.

As piston 16 engages the cylinder inner surface only through tightness lip **16*a*, it cannot provide for proper guiding of stem 15 but, filler 32 provides for such a guiding. With a view towards avoiding the filler to jam on sealing member 31**, such is preferably made of a different material.

Although only one preferred embodiment is specifically illustrated and described herein, it will be appreciated that many modifications and variations of the present invention are possible in light of the above teachings and within the purview of the appended claims without departing from the spirit an intended scope of the invention.

What we claim is:

1. A pump for a hand actuated device for producing an atomized spray, the pump comprising:

a cylinder having an end wall with a valve therein;

a piston slidable in the cylinder;

a hollow stem with a lateral opening at one end, being slidable in and extending through the piston for a lost movement connection and extending outside the cylinder at the opposite end thereof to the valve and having actuating means thereon, the piston being formed near the stem with a sealing member of a substantially triangular section with a thin edge placed towards an inner end of said stem for covering and uncovering the lateral opening in the stem as the stem moves relative to the piston;

an annular compression filler being provided around the piston triangular portion, having a conical inner surface adapted to the outer surface of the piston;

means for biasing the piston in opposite directions comprising first and second spring means, the first spring being disposed between the filler and the cylinder end wall with the valve and the second spring being positioned between the piston and a step on the hollow stem and being in a relaxed state when the pump is not in use, the second spring being weaker than the first spring means, the filler further comprising an outer surface in sliding engagement with an inner surface of said cylinder and an inner surface in sliding engagement with the inner end of said stem, so as to provide sliding guiding of said stem in said cylinder.

* * * * *

UNITED STATES PATENT AND TRADEMARK OFFICE

CERTIFICATE OF CORRECTION

PATENT NO. : 4,245,967

DATED : January 20, 1981

INVENTOR(S) : JEAN-CLAUDE G. BUSSELET

It is certified that error appears in the above—identified patent and that said Letters Patent is hereby corrected as shown below:

Column 1, line 13, between "such" and "to" insert --serves--.

Column 4, line 37, delete "means" and insert --moves-- line 50, delete "automization" and insert --atomization--.

Signed and Sealed this

*Second* Day of *June 1981*

[SEAL]

*Attest:*

RENE D. TEGTMEYER

*Attesting Officer*

*Acting Commissioner of Patents and Trademarks*